US009388501B2

(12) United States Patent
Jickling et al.

(10) Patent No.: US 9,388,501 B2
(45) Date of Patent: Jul. 12, 2016

(54) ELECTROLYTIC CATHODE ASSEMBLIES WITH HOLLOW HANGER BAR

(75) Inventors: Robert Stanley Jickling, Georgetown (CA); Gordon Steven Iverson, Oakville (CA); John Douglas Jickling, Oakville (CA)

(73) Assignee: EPCM SERVICES LTD., Oakville, Ontario (CA)

( * ) Notice: Subject to any disclaimer, the term of this patent is extended or adjusted under 35 U.S.C. 154(b) by 387 days.

(21) Appl. No.: 13/879,917

(22) PCT Filed: Oct. 18, 2011

(86) PCT No.: PCT/CA2011/050656

§ 371 (c)(1),
(2), (4) Date: Aug. 28, 2013

(87) PCT Pub. No.: WO2012/051714

PCT Pub. Date: Apr. 26, 2012

(65) Prior Publication Data

US 2013/0327639 A1 Dec. 12, 2013

Related U.S. Application Data

(60) Provisional application No. 61/394,074, filed on Oct. 18, 2010.

(51) Int. Cl.
*C25C 7/02* (2006.01)
*C25C 7/00* (2006.01)

(52) U.S. Cl.
CPC .... *C25C 7/02* (2013.01); *C25C 7/00* (2013.01)

(58) Field of Classification Search
CPC ..... C25C 7/00; C25C 7/02; C25B 9/02; C25B 11/00; C25B 11/02
USPC ..... 204/280, 286.1, 288
See application file for complete search history.

(56) References Cited

U.S. PATENT DOCUMENTS 3,857,774 A 12/1974 Morton et al.
4,014,763 A 3/1977 Lowe (Continued)

FOREIGN PATENT DOCUMENTS

CA 2489889 A1 12/2003
CA 2433989 A1 8/2004

(Continued)

OTHER PUBLICATIONS

International Preliminary Report on Patentability issued Apr. 23, 2013 in respect of International Application No. PCT/CA2011/050656.

(Continued)

*Primary Examiner* — Luan Van
*Assistant Examiner* — Alexander W Keeling
(74) *Attorney, Agent, or Firm* — Bereskin & Parr LLP/S.E.N.C.R.L., s.r.l.

(57) ABSTRACT

An electrolytic cathode assembly includes a hollow hanger bar, and a deposition plate including an upper edge attached to the hanger bar. The hanger bar can be formed substantially of copper. At least one supporting element can be configured to support the hanger bar. The supporting element(s) can be internally disposed within the hanger bar, and can extend partially between bar ends of the hanger bar. The supporting element(s) can include first and second supporting elements, with each disposed adjacent to a respective one of the bar ends. The hanger bar can include an overhanging portion, and the supporting element(s) can be at least partially disposed within the overhanging portion. The supporting element(s) can include an inward end that is offset inwardly relative to the plate edges of the deposition plate.

24 Claims, 7 Drawing Sheets

(56) References Cited

U.S. PATENT DOCUMENTS

| | | | | |
|---|---|---|---|---|
| 4,373,654 | A | 2/1983 | Prengaman et al. | |
| 4,479,854 | A | 10/1984 | Willans et al. | |
| 4,647,358 | A * | 3/1987 | Bartsch et al. | 204/288.2 |
| 4,882,027 | A | 11/1989 | Borst et al. | |
| 5,172,850 | A | 12/1992 | Prengaman et al. | |
| 5,492,609 | A | 2/1996 | Assenmacher | |
| 5,549,801 | A | 8/1996 | Perlich et al. | |
| 5,584,975 | A | 12/1996 | Pohto et al. | |
| 5,919,343 | A | 7/1999 | Sparapani | |
| 6,569,300 | B1 * | 5/2003 | Assenmacher | 204/286.1 |
| 6,746,581 | B2 | 6/2004 | Ebert | |
| 7,003,868 | B2 | 2/2006 | Preimesberger | |
| 7,285,193 | B2 | 10/2007 | Robinson et al. | |
| 7,306,706 | B2 | 12/2007 | Robinson et al. | |
| 7,332,064 | B2 * | 2/2008 | Webb | 204/281 |
| 7,344,624 | B2 | 3/2008 | Aslin et al. | |
| 2003/0010630 | A1 | 1/2003 | Polvi et al. | |
| 2006/0102470 | A1 | 5/2006 | Robinson et al. | |
| 2007/0051621 | A1 | 3/2007 | Webb | |
| 2009/0050488 | A1 * | 2/2009 | Jickling et al. | 205/291 |

FOREIGN PATENT DOCUMENTS

| | | | | |
|---|---|---|---|---|
| DE | 4241485 | C1 | 3/1994 | |
| EP | 0175395 | A1 | 5/1985 | |
| EP | 0301115 | B1 | 10/1990 | |
| GB | 2041002 | A | 9/1980 | |
| WO | 00/17419 | A1 | 3/2000 | |
| WO | 02/097170 | A2 | 12/2002 | |
| WO | 03/062497 | A1 | 7/2003 | |
| WO | WO 03106738 | A1 * | 12/2003 | 204/297.01 |
| WO | 2005/071142 | A1 | 8/2005 | |
| WO | 2006/094355 | A1 | 9/2006 | |
| WO | 2009/026678 | A1 | 3/2009 | |
| WO | 2012/051714 | A1 | 4/2012 | |

OTHER PUBLICATIONS

Cathodex, brochure.

Electrorefining of Copper.

ISA Process and Kidd Process Technologies, brochure.

Wayne Webb, The development of a “lower resistance” permanent cathode.

European search opinion and Supplementary European search report issued Apr. 29, 2014 in respect of European Patent Application No. 11833678.3.

Communication issued Apr. 2, 2015 in respect of European Patent Application No. 11833678.3.

* cited by examiner

ELECTROLYTIC CATHODE ASSEMBLIES WITH HOLLOW HANGER BAR

CROSS REFERENCE TO RELATED APPLICATIONS

This is a national stage application of International Application No. PCT/CA2011/050656 filed on Oct. 18, 2011, which claims priority to U.S. Provisional Application No. 61/394,074 filed on Oct. 18, 2010, and the entire contents of each are hereby incorporated herein by reference.

FIELD

This specification relates generally to electrolytic cathode assemblies typically used in the refining or winning of metals.

BACKGROUND

The following paragraphs are not an admission that anything discussed in them is prior art or part of the knowledge of persons skilled in the art.

U.S. Pat. No. 4,647,358 describes a current-feeding cathode-mounting device comprising a metal-sheathed carrying rail of copper and a permanent cathode plate consisting of the same material as the sheath and joined by welding at least along part of a longitudinal edge and wherein at least an end portion of the rail is unsheathed at least along part of its extent.

U.S. Pat. No. 7,332,064 describes a hanger bar for a cathode plate and a method of producing a cathode for electrolytic recovery of metal. The hanger bar comprises a support element which is preferably stainless steel and hollow. An electrically conductive metal cladding is affixed the stainless steel bar by any appropriate mechanism, e.g., interference fit, welding, chemical or mechanical fastening or coextrusion or roll forming.

U.S. Pat. No. 7,344,624 describes a cathode plate and method for electro-refining or electro-winning of metal. The cathode includes a cathode blade and hanger bar. A quantity of electrically conductive material is wrapped around the hanger bar and along the cathode blade to a position, in use, proximate the level of electrolyte in the electrolytic bath.

INTRODUCTION

In an aspect of this specification, an electrolytic cathode assembly can comprise: a hollow hanger bar formed substantially of copper; and a deposition plate including an upper edge attached to the hanger bar.

At least one supporting element can be configured to support the hanger bar. The at least one supporting element can be internally disposed within the hanger bar.

In some examples, the at least one supporting element can extend partially between bar ends of the hanger bar. The at least one supporting element can comprise first and second supporting elements, and the first and second supporting elements can be disposed adjacent to a respective one of the bar ends. The hanger bar can comprise overhanging portions which extend beyond respective plate edges of the deposition plate, and the first and second supporting elements can be at least partially disposed within a respective one of the overhanging portions. The first and second supporting elements each can comprise an inward end that is offset inwardly relative to a respective one of the plate edges of the deposition plate. In other examples, the at least one supporting element can extend substantially between bar ends of the hanger bar.

An external profile of the supporting element can be generally complementary to an internal profile of the hanger bar. The supporting element can be secured to the hanger bar by at least one of interference fit, adhesive and at least one weld. The supporting element can be hollow, or can be solid. The supporting element can be formed of stainless steel.

End caps can seal ends of the hanger bar. The end caps can be secured to the hanger bar by at least one of interference fit, adhesive and at least one weld. Outward ends of the supporting element can be offset from the end caps to define a thermal expansion gap.

In some examples, the hanger bar can be shaped as a rectangular tube. A bottom of the hanger bar can be rounded. Top and bottom walls of the hanger bar can have generally greater thickness dimensions than side walls of the hanger bar. In other examples, the hanger bar can be shaped as a cylindrical tube.

The deposition plate can be attached to the hanger bar by at least one weld. The deposition plate can be formed of stainless steel.

A protective covering can surround the hanger bar and a portion of the upper end of the deposition plate so as to substantially enclose a joint defined by the upper end of the deposition plate and the hanger bar. End portions of the hanger bar can be exposed outside of lateral ends of the protective covering. At each lateral end of the protective covering, a corrosion resistant material can be positioned to form a substantially continuous seal between the protective covering and the hanger bar, thereby to at least hinder fluid flow into the protective covering. At each lateral end of the protective covering, a sleeve can be positioned around and in abutment with a portion of an outer surface of the protective covering and adjacent the corresponding lateral end and the corresponding adjacent exposed portion of the hanger bar. The protective covering can be attached to the deposition plate by at least one weld. The protective covering can be formed of stainless steel.

In an aspect of this specification, an electrolytic cathode assembly can comprise: a hollow hanger bar; first and second supporting elements internally disposed within the hanger bar; and a deposition plate including an upper edge attached to the hanger bar, wherein the hanger bar includes overhanging portions which extend beyond respective plate edges of the deposition plate, wherein the first and second supporting elements are at least partially disposed within a respective one of the overhanging portions adjacent to a respective bar end of the hanger bar, and wherein each of the first and second supporting elements comprise an inward end that is offset inwardly relative to a respective one of the plate edges of the deposition plate.

In an aspect of this specification, an electrolytic cathode assembly can comprise: a hollow hanger bar; a deposition plate including an upper edge attached to the hanger bar; at least one supporting element configured to support the hanger bar; and a protective covering surrounding the hanger bar and a portion of the upper end of the deposition plate so as to substantially enclose a joint defined by the upper end of the deposition plate and the hanger bar.

In an aspect of this specification, an electrolytic cell can comprise: a tank containing an electrolytic bath; an anode assembly contained within the electrolytic bath; a cathode assembly as described herein contained within the electrolytic bath; and a power source electrically connected to the anode assembly and the cathode assembly to form the electrolytic cell.

In an aspect of this specification, a method of electro-refining or electro-winning a metal in an electrolytic cell can comprise: providing a tank containing an electrolytic bath; providing an anode assembly in the electrolytic bath; providing a cathode assembly as described herein in the electrolytic bath; providing a power source; electrically connecting the power source to the anode assembly and the cathode assembly to form the electrolytic cell; and applying a sufficient amount of current to the electrolytic cell to cause metal ions from the electrolytic bath to be deposited onto a surface of the deposition plate of the cathode assembly.

These and other features of the applicant's teachings are set forth herein.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Figure 1A:
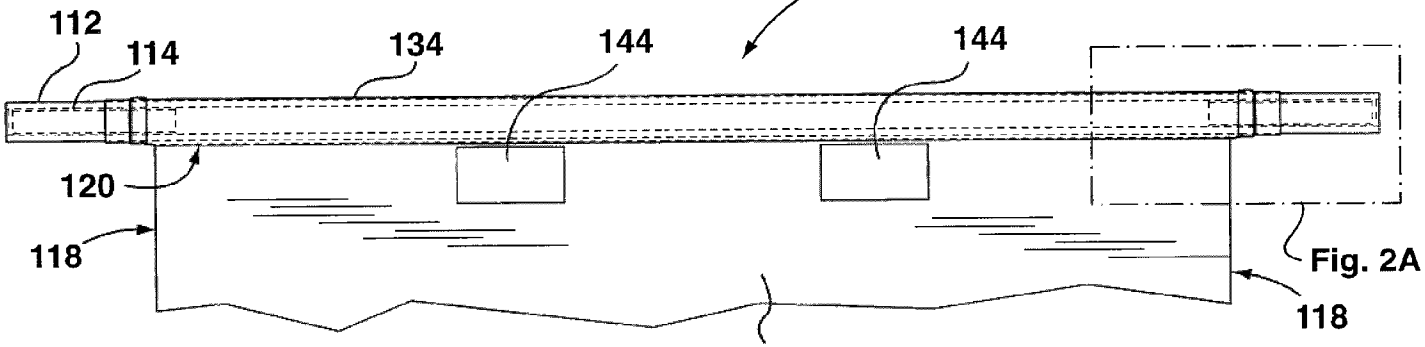
FIG. 1A is a partial side view of an electrolytic cathode assembly in accordance with a first example.

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Electro-refining of metals requires placing an anode made from the crude metal to be refined and a cathode together in a suitable electrolytic bath. Application of a voltage between the anode and the cathode causes the crude metal to oxidize and pure metal ions to go into solution and to migrate electrolytically through the electrolytic bath towards the cathode. The pure metal ions are deposited onto the cathode as a refined metal, usually of very high purity. The majority of the impurities are left behind in the electrolytic bath.

Electro-winning of metals requires placing an anode made from a metal that is different from the metal to be refined and a cathode together in a suitable electrolytic bath. The metal to be refined is added to the electrolytic bath in a soluble form (e.g., prepared from a leaching and solvent extraction process). Application of a voltage between the anode and cathode causes the metal to migrate from the solution and deposit onto the cathode as a refined metal of high purity.

A typical cathode assembly includes a flat deposition plate attached along an upper end to an electrically conductive hanger bar. The hanger bar is in electrical contact with an external power source. In some configurations, both ends of the hanger bar rest on an electrically conductive bus bar that runs along edges of the tank. In other configurations, one end of the hanger bar rests on an electrically conductive bus bar that runs along one edge of the tank and the other end of the hanger bar rests on an electrically insulated bar that runs along the opposite edge of the tank. The hanger bar supports the deposition plate within the electrolytic bath and provides a path for the flow of electricity between the power source and the deposition plate.

After a suitable thickness of refined metal has been deposited onto the surface of the deposition plate, the cathode assembly is removed from the electrolytic bath. In cases where the deposition plate is permanent (e.g., formed from a different metal than the metal to be refined), the refined metal can be recovered by any known stripping techniques. Often, vertical side edges of the deposition plate are covered or protected, so that deposition of copper or other desired metal occurs only on the flat side faces of the deposition plate and around a lower edge thereof.

In some cases, a cathode assembly includes an electrically conductive hanger bar (e.g., copper) coupled together with a permanent deposition plate (e.g., stainless steel). The upper end of the deposition plate is typically inserted into a slot or groove provided along the underside of the hanger bar. The deposition plate is then attached to the hanger bar with a weld. A hollow hanger bar may result in lower weight and less material costs, but also a corresponding reduction in strength of the cathode assembly.

Figure 1B:
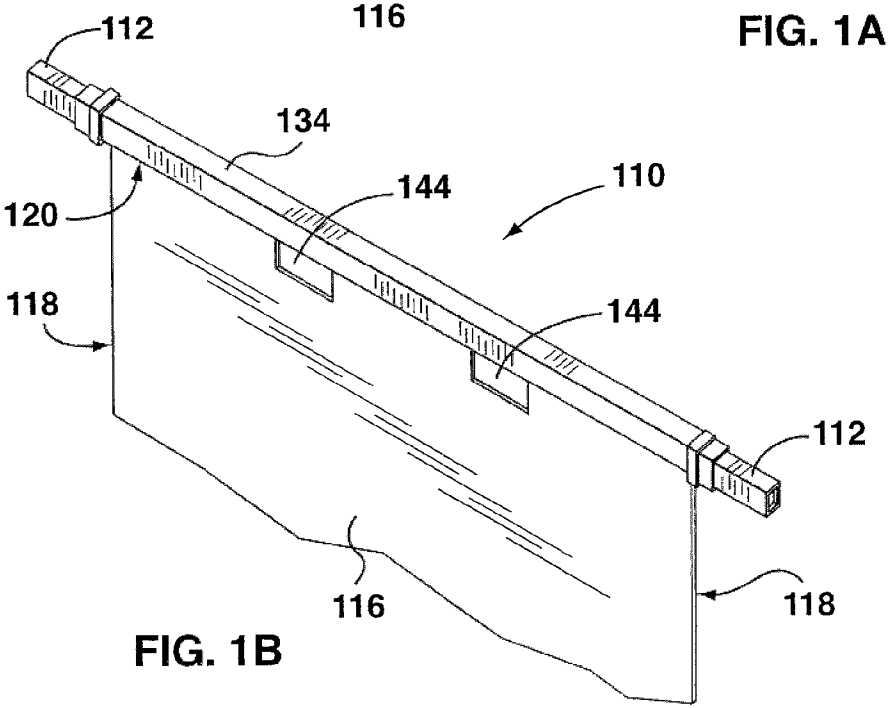
FIG. 1B is a partial perspective view of the cathode assembly of FIG. 1A.
Figure 2A:
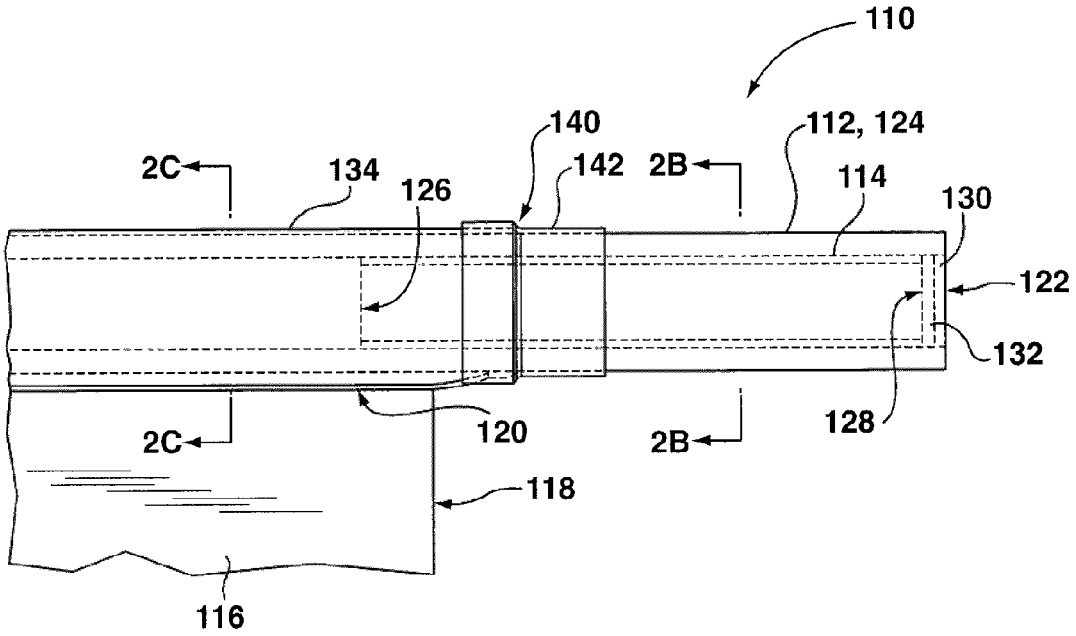
FIG. 2A is an enlarged partial side view of a lateral end of the cathode assembly of FIG. 1A.

Referring to FIGS. 1A, 1B and 2A, an electrolytic cathode assembly is shown generally at 110.

The cathode assembly 110 includes a hollow hanger bar 112. The hanger bar 112 may be manufactured substantially from copper. In some examples, the hanger bar 112 may be manufactured from C11000 Electrolytic Tough Pitch (ETP) copper.

The cathode assembly 110 may include at least one supporting element 114. In the example illustrated, supporting elements 114 are internally disposed within the hanger bar 112.

The cathode assembly 110 further includes a deposition plate 116. The deposition plate 116 includes plate edges 118 and an upper edge 120 attached to the hanger bar 112.

The deposition plate 116 may be manufactured from an electrically conductive material having a relatively high tensile strength and good corrosion resistance. In some examples, the deposition plate 116 may be manufactured from Grade 316L stainless steel or other alloys with acceptable anti-corrosion properties and with, for example, a "2B"

finish. It will be understood that various finishes can be used depending upon the particular application.

Figure 2B:
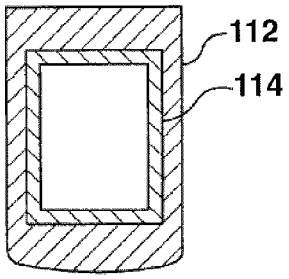
FIG. 2B is a sectional view along lines 2B-2B of FIG. 2A.
Figure 2C:
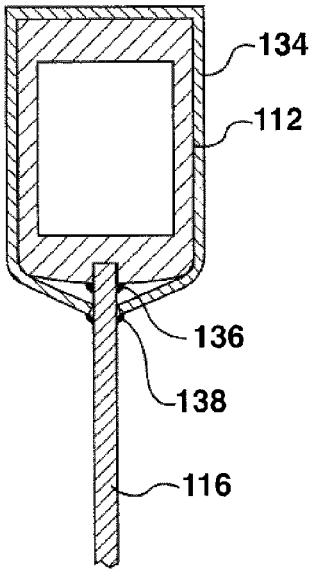
FIG. 2C is a sectional view along lines 2C-2C of FIG. 2A.

The deposition plate 116 may be attached to the hanger bar 112 by providing a slot in the hanger bar and then welding the deposition plate 116 to the hanger bar 112 (as indicated at 136 in FIG. 2C). Alternatively, the deposition plate 116 may be welded directly to the hanger bar 112 without a slot. As high currents can be present in use and it may be desirable to avoid high current concentrations at individual locations, the deposition plate 116 may be welded to the hanger bar 112 along its length on one or both sides, either with continuous welds or with stitch welds. It will also be understood that while reference here is made to welding the deposition plate 116 to the hanger bar 112, as these may be formed from dissimilar materials, this could be characterized more as a braze than a true welding operation.

Openings 144 may be provided in the deposition plate 116 to facilitate lifting the cathode assembly out of the tank (not shown). Alternatively, other cathode assemblies can be provided with lifting hooks.

Referring particularly to FIG. 2B, the hanger bar 112 may be shaped as a rectangular tube with a generally flat top and flat sides, and rounded on the bottom. While a rounded bottom is shown, the bottom could be flat, and in general the profile of the hanger bar 112 can be varied. As illustrated, in some examples, top and bottom walls of the hanger bar 112 may have greater thickness dimensions than side walls of the hanger bar 112 to provide relatively high beam strength and sufficient cross sectional area for conducting electricity, while minimizing weight. An external profile of the supporting element 114 may be generally complementary to an internal profile of the hanger bar 112, ensuring a good fit so that the supporting element 114 may reinforce the hanger bar 112. The supporting element 114 may be secured to the hanger bar 112 by interference fit, adhesive, welding, or a combination thereof. As illustrated, the supporting element 114 may be hollow, and may be shaped as a rectangular tube.

Referring again to FIGS. 1A, 1B and 2A, an optional protective covering 134 may be provided around the hanger bar 112 to cover the weld 136 (see FIG. 2C) and substantially enclose a joint defined by the upper edge 120 of the deposition plate 116 and the hanger bar 112. The protective covering 134 provides additional structural strength to the cathode assembly 110, and may be formed from material that is the same or similar as the deposition plate 116, for example but not limited to stainless steel or other alloys with acceptable anti-corrosion properties. The protective covering 134 may be provided closely around the hanger bar 112, but it may not be so tight as to prevent fluid penetration. Lower edges of the protective covering 134 come into abutment with the deposition plate 116 and are welded thereto (as indicated at 138 in FIG. 2C). These welds may extend along the entire length of the lower edges of the protective cover 134 where they contact the deposition plate 116.

Referring particularly to FIG. 2A, the protective covering 134 may extend beyond the plate edges 118 of the deposition plate 116, and outer parts of the lower edges of the protective covering 134 face one another directly; if necessary they may be further deformed or pressed so as to abut or be close to one another. Then, additional welds may used to close off these portions of the protective covering 134. Overall, the scheme is such as to ensure that, with respect to the protective covering 134 and the deposition plate 116, there is a continuous weld or seal and no opening is left for penetration of fluid, except at the ends of the protective covering 134.

Corrosive fluid from the electrolytic bath and/or the cathode wash process may potentially penetrate between the protective covering 134 and the hanger bar 112, at the ends of the protective covering 134. As indicated at 140, at either end of the protective covering 134, it provides a lateral end or edge 140. These lateral ends 140 then leave portions of the overhanging portions 124 of the hanger bar 112 exposed, at either end of the hanger bar 112.

At each lateral end 140 of the protective covering 134, a sleeve 142 may be positioned around and in abutment with a portion of an outer surface of the protective covering 134 and adjacent the corresponding lateral end 140, and the corresponding adjacent exposed portion of the hanger bar 112. The sleeve 142 may be formed of corrosion resistant material and may be positioned to form a substantially continuous seal between the protective covering 134 and the hanger bar 112, thereby to at least hinder fluid flow into the protective covering 134. Further details and examples of sealing the lateral end 140 of the protective covering 134 are provided in International Publication No. WO 2009/026678 A1, which is hereby incorporated herein by reference in its entirety.

In the example illustrated, referring again to FIG. 2A, the two supporting elements 114 extend only partially between bar ends 122 of the hanger bar 112. Each of the supporting elements 114 are disposed adjacent to a respective one of the bar ends 122, and are at least partially disposed within overhanging portions 124 of the hanger bar 112 which extend beyond the respective plate edges 118 of the deposition plate 116. An inward end 126 of the supporting element 114 may be offset inwardly relative to a respective one of the plate edges 118 of the deposition plate 116.

It should be understood that the supporting elements 114 serve to reinforce the hanger bar 112. In the example illustrated, the overhanging portions 124 are generally exposed and may carry the bulk of the weight of the cathode assembly 110 when in use in an electrolytic tank. The supporting elements 114 are arranged to distribute load from the overhanging portions 124 to the rest of the hanger bar 112 and the protective covering 134. The supporting elements 114 are also arranged to prevent bending, denting, etc., of the overhanging portions 124 of the hanger bar 112, which are generally exposed beyond the lateral ends 140 of the protective covering 134. By extending only partially between the bar ends 122 of the hanger bar 112, the supporting elements 114 offer weight savings versus a supporting member that extends entirely between the bar ends 122.

The supporting element 114 may be manufactured from an electrically conductive material having a relatively high tensile strength, and corrosion resistance may not be necessary as the supporting element 114 is generally not exposed to corrosive fluid from the electrolytic bath and/or the cathode wash process. In some examples, the supporting element 114 may be manufactured from carbon steel or Grade 304 stainless steel, at a thickness of 16-gauge or more.

An outward end 128 of the supporting element 114 may be offset relative to end caps 130, to define a thermal expansion gap 132. The end caps 130 may be provided to seal the bar ends 122 of the hanger bar 112, and may be secured to the hanger bar 112 using interference fit, adhesive, welding, or a combination thereof.

Figure 3A:
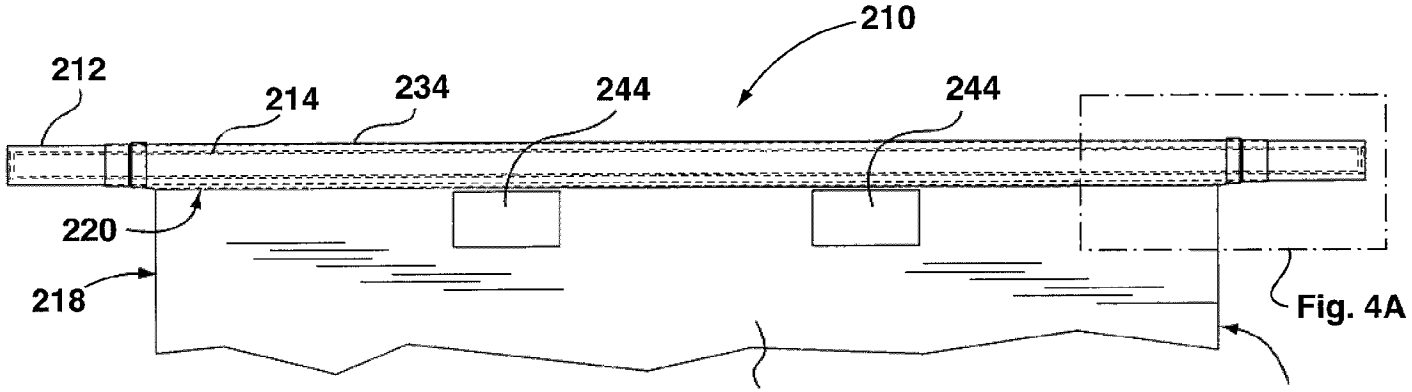
FIG. 3A is a partial side view of an electrolytic cathode assembly in accordance with a second example.
Figure 3B:
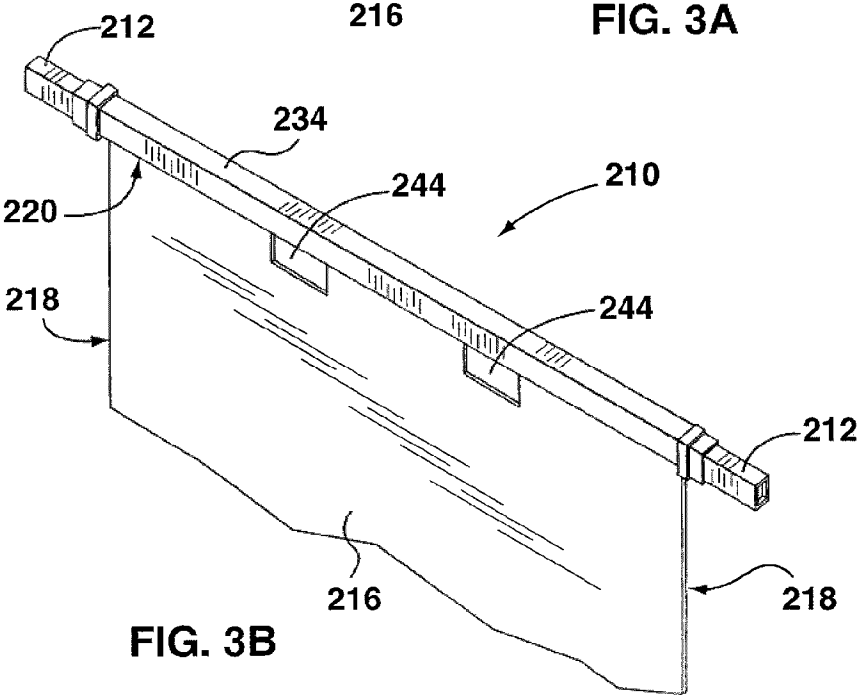
FIG. 3B is a partial perspective view of the cathode assembly of FIG. 3A.
Figure 4A:
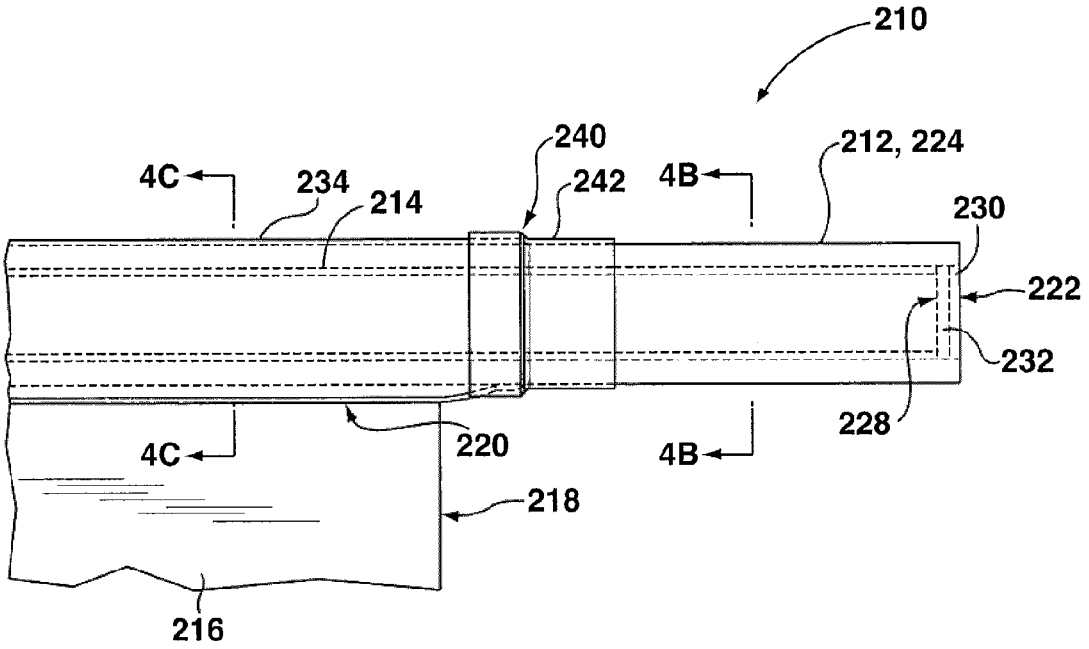
FIG. 4A is an enlarged partial side view of a lateral end of the cathode assembly of FIG. 3A.
Figure 4B:
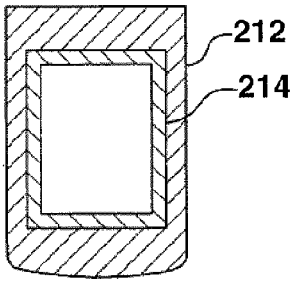
FIG. 4B is a sectional view along lines 4B-4B of FIG. 4A.
Figure 4C:
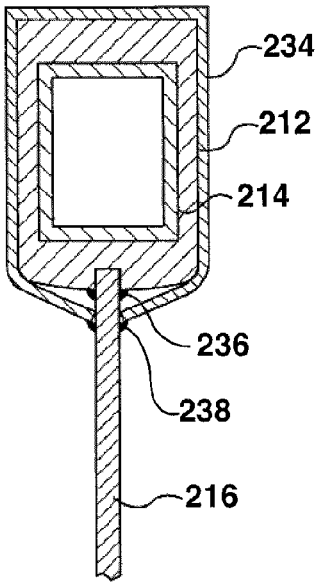
FIG. 4C is a sectional view along lines 4C-4C of FIG. 4A.

FIGS. 3A, 3B and 4A illustrate another cathode assembly generally at 210. For simplicity and brevity, like components are given the same reference numeral, and the description of these components is not repeated. It is to be understood that, at least in some instances, some of these components may need some changes in dimensions, etc., to accommodate these different examples and variants, but otherwise function similarly as in the other examples herein.

The cathode assembly 210 includes a supporting element 214 disposed within a hanger bar 212, which is generally similar to the hanger bar 112. The supporting element 214 extends substantially between bar ends 222 of the hanger bar 212, keeping in mind that an outward end 228 of the supporting element 214 may be offset relative to end caps 230 to define a thermal expansion gap 232.

Figure 5A:
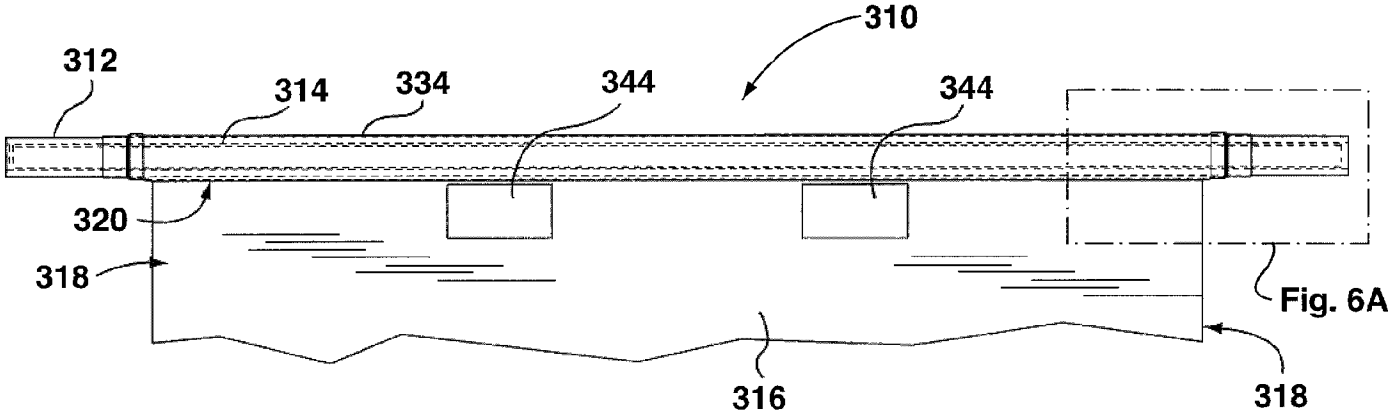
FIG. 5A is a partial side view of an electrolytic cathode assembly in accordance with a third example.
Figure 5B:
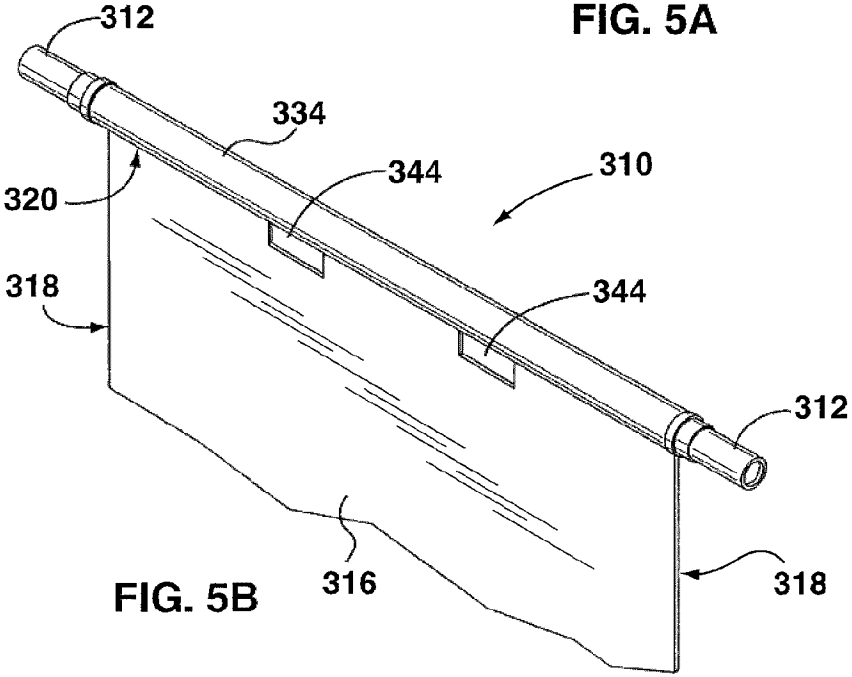
FIG. 5B is a partial perspective view of the cathode assembly of FIG. 5A.
Figure 6A:
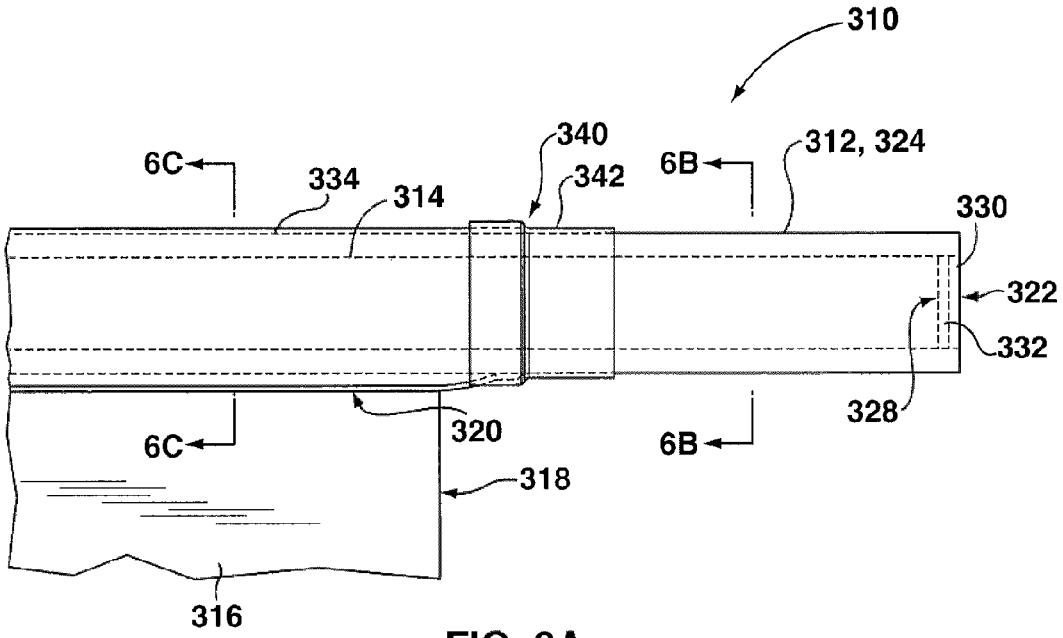
FIG. 6A is an enlarged partial side view of a lateral end of the cathode assembly of FIG. 5A.

FIGS. 5A, 5B and 6A illustrate another cathode assembly generally at 310. For simplicity and brevity, like components are given the same reference numeral, and the description of these components is not repeated. It is to be understood that, at least in some instances, some of these components may need some changes in dimensions, etc., to accommodate these different examples and variants, but otherwise function similarly as in the other examples herein.

The cathode assembly 310 includes a supporting element 314 disposed within a hanger bar 312. The supporting element 314 extends substantially between bar ends 322 of the hanger bar 312, keeping in mind that an outward end 328 of the supporting element 314 may be offset relative to end caps 330 to define a thermal expansion gap 332.

Figure 6B:
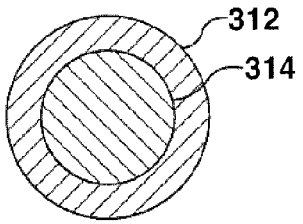
FIG. 6B is a sectional view along lines 6B-6B of FIG. 6A.
Figure 6C:
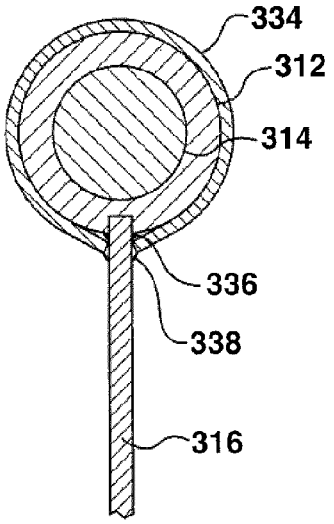
FIG. 6C is a sectional view along lines 6C-6C of FIG. 6A.

Referring to FIGS. 6B and 6C, the hanger bar 312 may be shaped as a cylindrical tube, and the supporting element 314 may be formed to be a solid cylinder. However, it should be understood that the profiles of the hanger bar and the supporting element can be varied. For instance, the support element may also be shaped as a cylindrical tube.

It should be appreciated that various other configurations of electrolytic cathode assemblies are possible. For example, an electrolytic cathode assembly may be manufactured to include a hollow hanger bar without an internal supporting element. In such examples, one or more supporting elements may be externally arranged to support the hanger bar, and optionally connected to a protective covering surrounding the hanger bar and an upper end of the deposition plate. In other examples, a protective covering alone may serve as the supporting element for a hollow hanger bar. In yet other examples, a supporting element may be omitted entirely. Furthermore, in some examples, a protective covering may be extended towards the respective bar end of a hollow hanger bar, with a bottom portion of the protective covering removed to enable contact between the hanger bar and bus bars. Moreover, in other examples, a protective covering may be omitted entirely.

Figure 7:
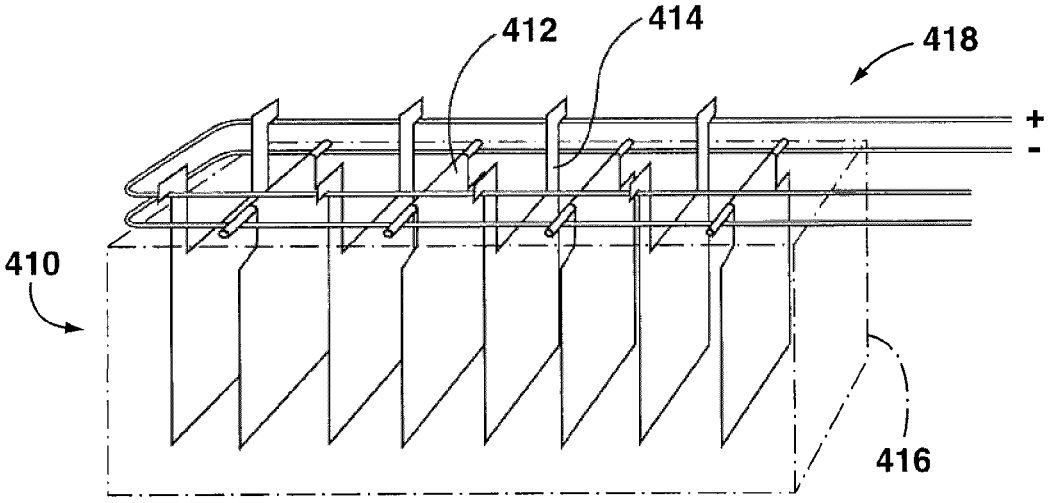
FIG. 7 is a schematic view of an exemplary electrolytic cell.

Referring to FIG. 7 there is shown an electrolytic cell arrangement indicated generally by the reference 410. Here, anodes 412 and cathodes 414 are suspended in a tank 416. Generally similar arrangements are used for electro-winning and electro-refining. For electro-winning, a solution is provided which the desired metal, e.g., copper, is in a solution. Electrolysis is then used to cause the copper or the desired metal to deposit on the cathodes. In electro-refining, metal already recovered, e.g., again copper, is provided as the anode, and by way of electrolysis is caused to go into solution and then deposit on the cathodes; the electro-refining operation has conditions set to encourage deposition of the desired copper on the cathodes, while leaving other undesired metals and other materials in solution, or otherwise not deposited on the cathodes.

Here, the anodes 412 and the cathodes 414 are indicated. Connections to a power source (not shown) are indicated at 418. The electrolytic solution or bath would be chosen to be suitable for the particular operation, e.g., electro-winning or electro-refining, and would be maintained at desired temperatures, etc.

While the above description provides examples of one or more processes or apparatuses, it will be appreciated that other processes or apparatuses may be within the scope of the accompanying claims.

We claim:

1. An electrolytic cathode assembly, comprising:

a hollow hanger bar formed substantially of copper;

a deposition plate including an upper edge attached to the hanger bar; and first and second supporting elements configured to support and reinforce the hanger bar, wherein the first and second supporting elements are internally disposed within the hanger bar, wherein the first and second supporting elements extend partially between bar ends of the hanger bar, wherein each of the first and second supporting elements is disposed adjacent to a respective one of the bar ends, wherein the hanger bar comprises overhanging portions which extend beyond respective plate edges of the deposition plate, and each of the first and second supporting elements is at least partially disposed within a respective one of the overhanging portions, and wherein each of the first and second supporting elements comprises an inward end that is offset inwardly relative to a respective one of the plate edges of the deposition plate, and wherein the assembly includes end caps to seal ends of the hanger bar, and outward ends of the supporting elements are offset from the end caps to define a thermal expansion gap.

2. The assembly of claim 1, wherein an external profile of each supporting element is complementary to an internal profile of the hanger bar.

3. The assembly of claim 1, wherein each supporting element is secured to the hanger bar by at least one of interference fit, adhesive and at least one weld.

4. The assembly of claim 1, wherein each supporting element is hollow.

5. The assembly of claim 1, wherein each supporting element is solid.

6. The assembly of claim 1, wherein each supporting element is formed of stainless steel.

7. The assembly of claim 1, wherein the end caps are secured to the hanger bar by at least one of interference fit, adhesive and at least one weld.

8. The assembly of claim 1, wherein the hanger bar is shaped as a rectangular tube.

9. The assembly of claim 8, wherein a bottom of the hanger bar is rounded.

10. The assembly of claim 8, wherein top and bottom walls of the hanger bar have greater thickness dimensions than side walls of the hanger bar.

11. The assembly of claim 1, wherein the hanger bar is shaped as a cylindrical tube.

12. The assembly of claim 1, wherein the deposition plate is attached to the hanger bar by at least one weld.

13. The assembly of claim 1, wherein the deposition plate is formed of stainless steel.

14. The assembly of claim 1, further comprising a protective covering surrounding the hanger bar and a portion of the upper edge of the deposition plate so as to substantially enclose a joint defined by the upper edge of the deposition plate and the hanger bar.

15. The assembly of claim 14, wherein end portions of the hanger bar are exposed outside of lateral ends of the protective covering.

16. The assembly of claim 15, further comprising, at each lateral end of the protective covering, a corrosion resistant material positioned to form a substantially continuous seal between the protective covering and the hanger bar, thereby to at least hinder fluid flow into the protective covering.

17. The assembly of claim 15, further comprising, at each lateral end of the protective covering, a sleeve positioned around and in abutment with a portion of an outer surface of the protective covering and adjacent the corresponding lateral end and the corresponding adjacent exposed portion of the hanger bar.

18. The assembly of claim 15, wherein the protective covering is attached to the deposition plate by at least one weld.

19. The assembly of claim 15, wherein the protective covering is formed of stainless steel.

20. An electrolytic cathode assembly, comprising:

a hollow hanger bar;

end caps to seal ends of the hanger bar;

first and second supporting elements internally disposed within the hanger bar; and a deposition plate including an upper edge attached to the hanger bar, wherein the hanger bar includes overhanging portions which extend beyond respective plate edges of the deposition plate, wherein each of the first and second supporting elements are at least partially disposed within a respective one of the overhanging portions adjacent to a respective bar end of the hanger bar, wherein each of the first and second supporting elements comprises an inward end that is offset inwardly relative to a respective one of the plate edges of the deposition plate, and wherein each of the first and second supporting elements comprises an outward end that is offset inwardly relative to a respective one of the end caps to define a thermal expansion gap.

21. The assembly of claim 15, wherein each lateral end of the protective covering is offset outwardly relative to a respective one of the plate edges of the deposition plate.

22. The assembly of claim 21, wherein each of the first and second supporting elements comprises an inward end that is offset inwardly relative to a respective one of the plate edges of the deposition plate.

23. The assembly of claim 20, further comprising a protective covering surrounding the hanger bar and a portion of the upper edge of the deposition plate so as to substantially enclose a joint defined by the upper edge of the deposition plate and the hanger bar.

24. The assembly of claim 23, wherein end portions of the hanger bar are exposed outside of lateral ends of the protective covering, and each lateral end of the protective covering is offset outwardly relative to a respective one of the plate edges of the deposition plate.

* * * * *